US007617757B2

(12) United States Patent
Dickson

(10) Patent No.: US 7,617,757 B2
(45) Date of Patent: Nov. 17, 2009

(54) CERAMIC MULTI-HIT ARMOR

(75) Inventor: Lawrence J. Dickson, Granville, OH (US)

(73) Assignee: Composix Co., Newark, OH (US)

( * ) Notice: Subject to any disclaimer, the term of this patent is extended or adjusted under 35 U.S.C. 154(b) by 188 days.

(21) Appl. No.: 11/440,669

(22) Filed: May 25, 2006

(65) Prior Publication Data

US 2009/0229453 A1 Sep. 17, 2009

Related U.S. Application Data

(60) Provisional application No. 60/684,909, filed on May 26, 2005.

(51) Int. Cl.
*F41H 5/08* (2006.01)

(52) U.S. Cl. ..... 89/36.02; 89/36.05; 2/2.5

(58) Field of Classification Search ..... 89/36.05, 89/36.02; 2/2.5
See application file for complete search history.

(56) References Cited

U.S. PATENT DOCUMENTS

| | | | | |
|---|---|---|---|---|
| 3,702,593 | A | 11/1972 | Fine | |
| 4,125,053 | A | 11/1978 | Lasker | |
| 4,739,690 | A | 4/1988 | Moskowitz | |
| 4,934,245 | A * | 6/1990 | Musante et al. | 89/36.02 |
| 5,970,843 | A | 10/1999 | Strasser et al. | |
| 5,976,656 | A * | 11/1999 | Giraud | 428/44 |
| 6,009,789 | A | 1/2000 | Lyons | |
| 6,035,438 | A | 3/2000 | Neal et al. | |
| 6,112,635 | A | 9/2000 | Cohen | |
| 6,135,006 | A | 10/2000 | Strasser et al. | |
| 6,203,908 | B1 | 3/2001 | Cohen | |
| 6,289,781 | B1 | 9/2001 | Cohen | |
| 6,314,858 | B1 | 11/2001 | Strasser et al. | |
| 6,332,390 | B1 | 12/2001 | Lyons | |
| 6,408,733 | B1 * | 6/2002 | Perciballi | 89/36.02 |
| 6,408,734 | B1 | 6/2002 | Cohen | |
| 6,510,777 | B2 | 1/2003 | Neal | |
| 6,532,857 | B1 | 3/2003 | Shih et al. | |
| 6,601,497 | B2 | 8/2003 | Ghiorse et al. | |
| 6,792,843 | B2 | 9/2004 | Mohr et al. | |
| 6,860,186 | B2 | 3/2005 | Cohen | |
| 6,892,623 | B2 | 5/2005 | Benyami et al. | |
| 6,920,817 | B2 | 7/2005 | Ravid et al. | |
| 7,082,868 | B2 | 8/2006 | Reichman | |
| 7,117,780 | B2 | 10/2006 | Cohen | |
| 2004/0020353 | A1 | 2/2004 | Ravid et al. | |
| 2004/0118271 | A1 | 6/2004 | Puckett et al. | |
| 2005/0217471 | A1 * | 10/2005 | Benitsch | 89/36.02 |
| 2006/0162537 | A1 * | 7/2006 | Anderson et al. | 89/36.02 |

FOREIGN PATENT DOCUMENTS

| | | | |
|---|---|---|---|
| DE | 4005904 | A1 * | 8/1991 |
| DE | 19834393 | | 2/2000 |
| EP | 1536199 | | 11/2003 |
| GB | 2336807 | | 11/1999 |
| GB | 2377006 | | 12/2002 |
| WO | WO 2005/114089 | | 12/2005 |
| WO | WO 2005/114089 | A1 * | 12/2005 |

OTHER PUBLICATIONS

International Search Report and Written Opinion from related PCT/US2006/020271, mailed May 30, 2007.

* cited by examiner

*Primary Examiner*—Stephen M Johnson
(74) *Attorney, Agent, or Firm*—Calfee, Halter & Griswold LLP

(57) ABSTRACT

A ballistic structure for armor with improved multi-hit behavior includes at least a ceramic element and at least one defined void in the ceramic element to separate the ceramic element into separate ballistic segments. The defined void is, for example, a slit of given depth and width.

4 Claims, 6 Drawing Sheets

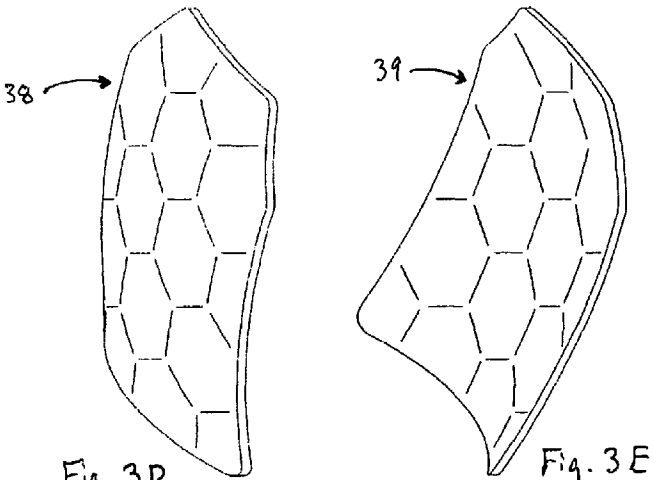
Fig. 3E
Fig. 3D
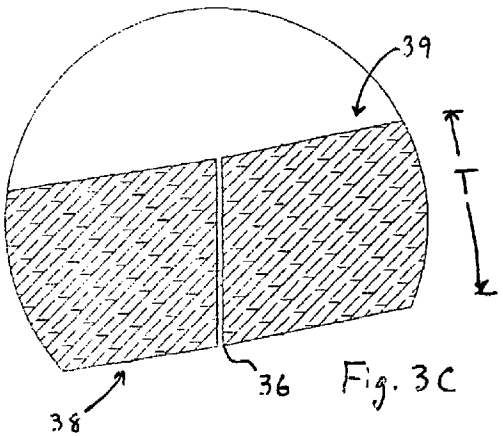
Fig. 3C
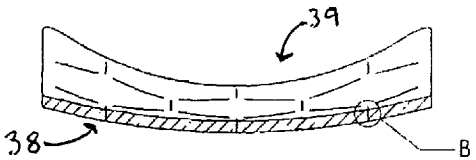
Fig. 3B
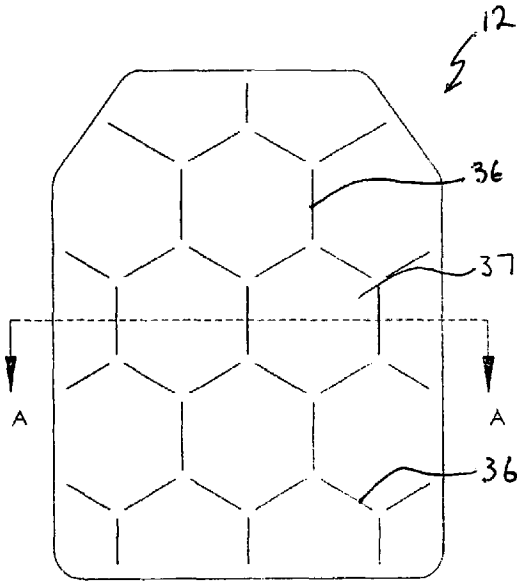
Fig. 3A

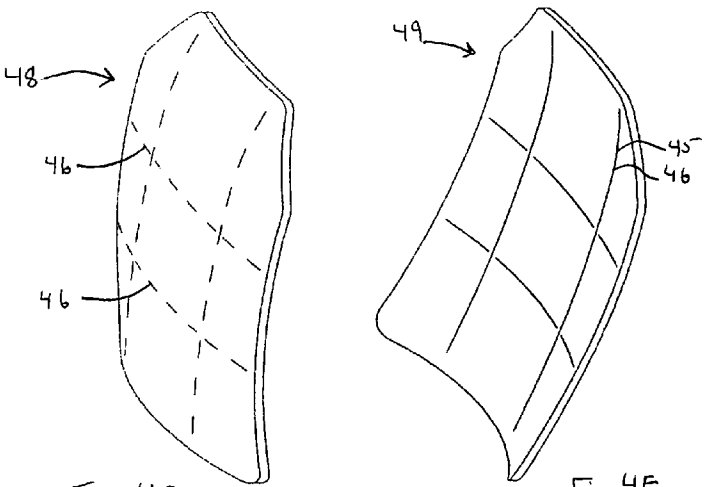
Fig. 4E
Fig. 4D
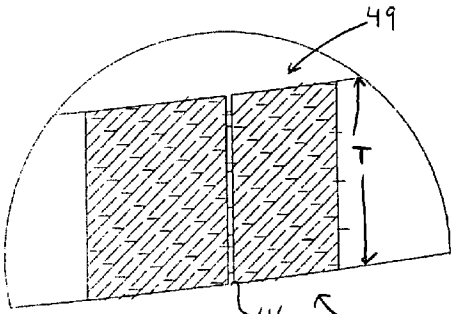
Fig. 4C
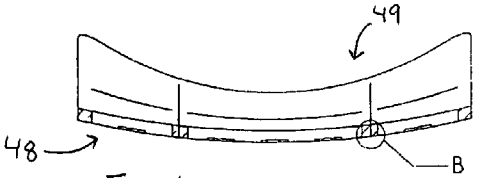
Fig. 4B
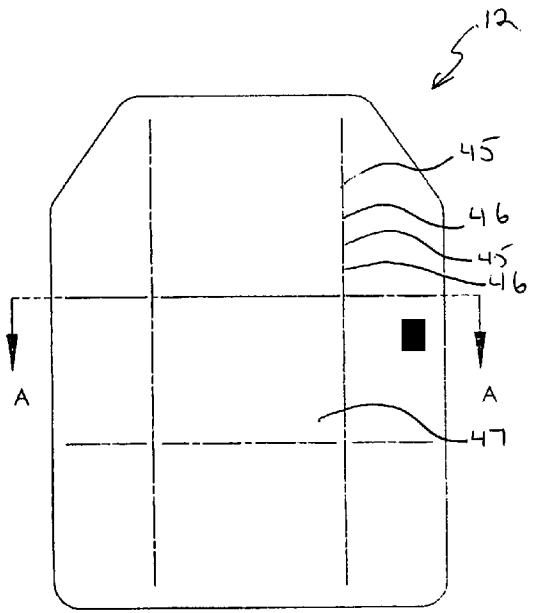
Fig. 4A

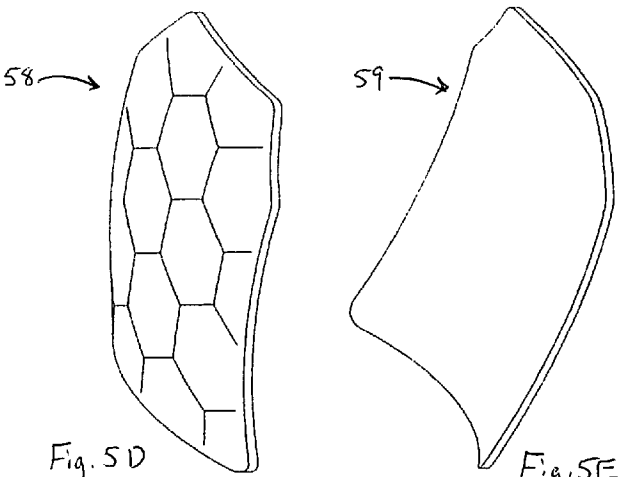
Fig. 5E
Fig. 5D
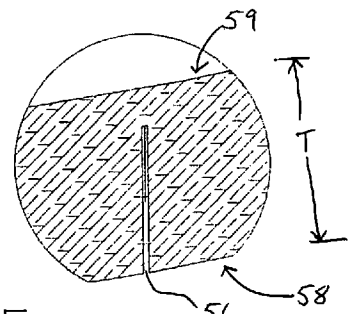
Fig. 5C
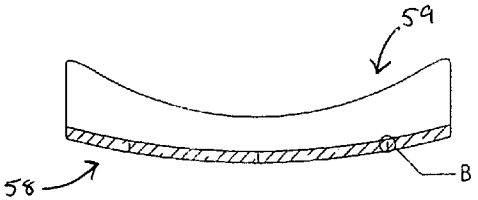
Fig. 5B
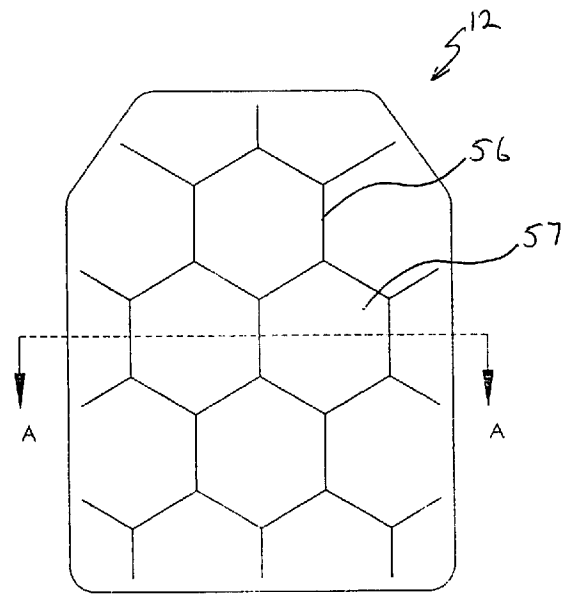
Fig. 5A

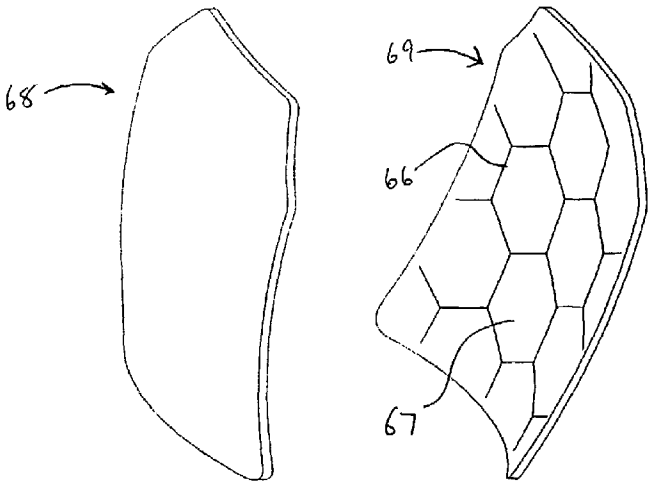
Fig. 6E
Fig. 6D
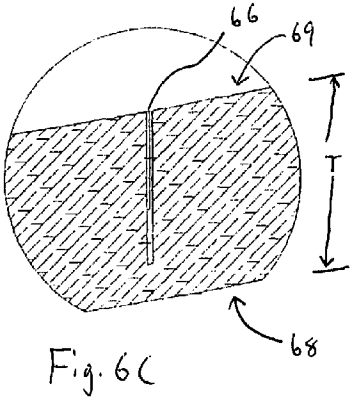
Fig. 6C
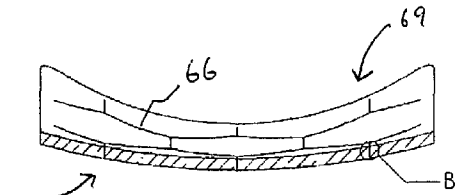
Fig. 6B
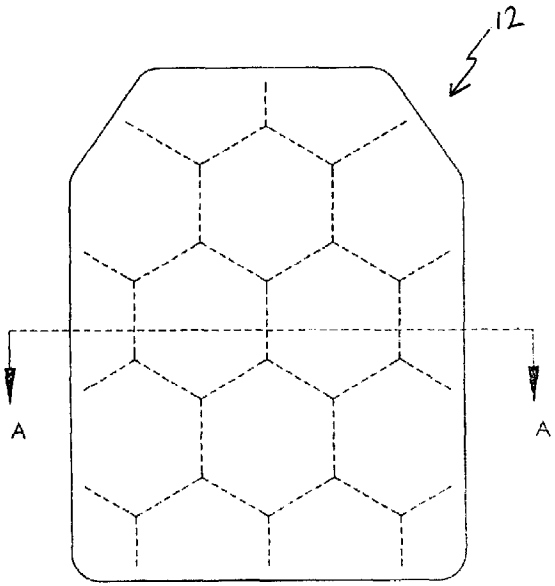
Fig. 6A

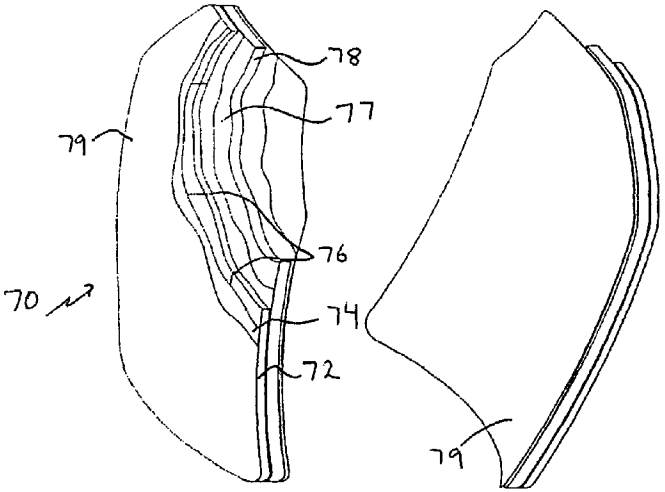
Fig. 7D
Fig. 7E
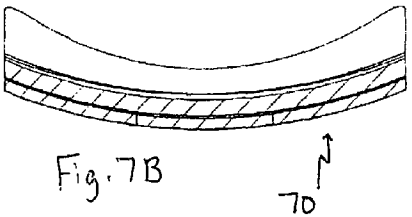
Fig. 7B
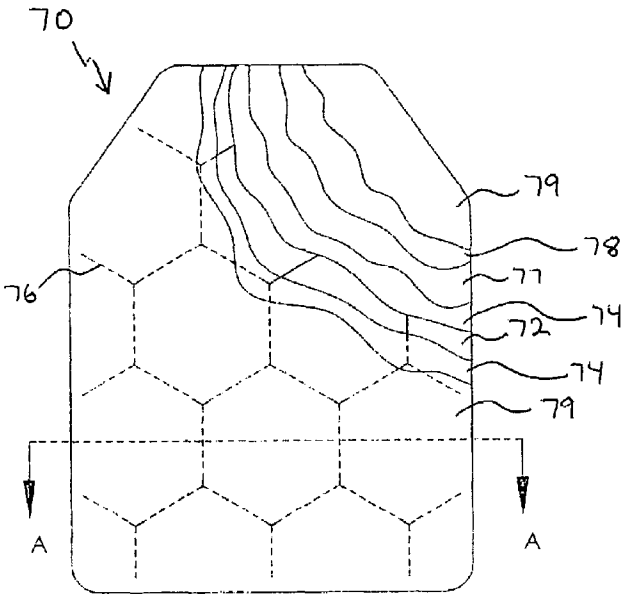
Fig. 7A
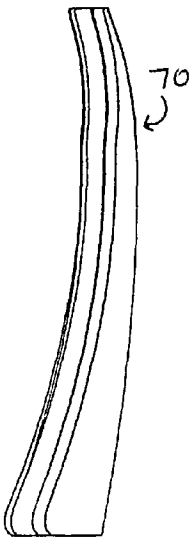
Fig. 7C

CERAMIC MULTI-HIT ARMOR

CROSS REFERENCE TO RELATED APPLICATION

This application claims priority to, and the benefit under 35 U.S.C. § 119(e) of, U.S. Provisional Application 60/684,909 filed May 26, 2005, titled CERAMIC MULTI-HIT ARMOR, which application is hereby incorporated by reference in its entirety.

FIELD OF THE INVENTION

The present invention relates generally to ceramic armor used for preventing the penetration of structures by high speed projectiles. The present invention relates to an improved ceramic multi-hit armor, and, more particularly, to improving the multi-hit performance through the incorporation of a defined void in the ceramic element of a ceramic faced ballistic armor system.

BACKGROUND

Historically, soldiers were protected by heavy metallic armors made from, for example, iron or high alloy steels. As more powerful and sophisticated armor piercing projectiles were developed, armors made from these conventional materials had to be made more resistant to penetration. This was generally achieved by making the armor thicker, which had the disadvantage of making the armor heavier.

More recently, ceramic-based armors have been developed. Ceramics are used in the fabrication of armors because they are lightweight and extremely hard materials. One of the drawbacks with ceramic armors, however, is that they dissipate the energy of the projectile partially by cracking. Therefore, ceramic armors lack repeat hit capability, i.e., they will not resist penetration if hit in the same position multiple times, and they disintegrate if struck by multiple rounds.

Ceramic containing armor systems have demonstrated great promise as reduced weight armors. These armor systems function efficiently by shattering the hard core of a projectile during impact on the ceramic material. The lower velocity bullet and ceramic fragments produce an impact, over a large "footprint", on a backing plate which supports the ceramic plates. The large footprint enables the backing plate to absorb the incident kinetic energy, through plastic and/or viscoelastic deformation, without being breached.

There is an increasing need for low-cost, light-weight armor systems that exhibit exceptional multiple-hit performance, have reliable attachment, and show excellent resistance to all hostile environments. There is a particular need for Small Arms Protective Inserts (SAPI) plates used by soldiers to enhance their body armor protection.

Lightweight protective armor, suitable for use by personnel, has been generally ineffective against armor piercing projectiles when multiple hits are required.

BRIEF DESCRIPTION OF THE DRAWINGS

FIGS. 3A through 3E represent an exemplary ceramic element of a SAPI plate with a pattern of slits;

FIGS. 4A through 4E represent an exemplary ceramic element of a SAPI plate with a pattern of alternating through slits and slits that extend only partially through the thickness of the ceramic element;

FIGS. 5A through 5E represent an exemplary ceramic element of a SAPI plate with a pattern of slits that begin on the front surface of the plate and extend only partially through the thickness of the ceramic element;

FIGS. 6A through 6E represent an exemplary ceramic element of a SAPI plate with a pattern of slits that begin on the rear surface of the plate and extend only partially through the thickness of the ceramic element; and FIGS. 7A through 7E represent a partial cutaway view of an exemplary finished armor plate ballistic structure with a ceramic element, a ceramic reinforcing element, an adhesive element, a composite backing element, and a spall cover.

DETAILED DESCRIPTION

Figure 2B:
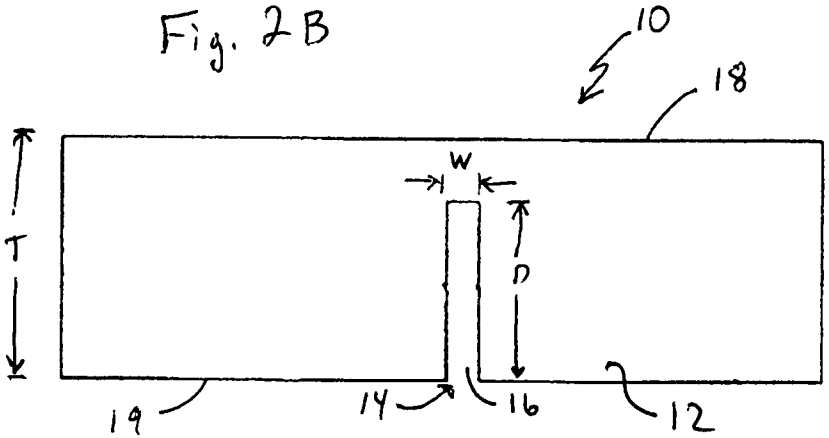
FIGS. 2A and 2B are is a cross-sectional view of an exemplary ceramic element with a slit that passes partially thru the thickness of the ceramic element and does not penetrate the rear surface.

Ceramic-faced armor systems are capable of defeating armor piercing projectiles by shattering the hard core of the threat in the ceramic component and terminating the fragment energy in the backing component. After impact, the armor system is damaged. One way for the armor to be capable of defeating subsequent hits with a given proximity to previous hits is to control the size of the damaged zone.

In armor systems containing an array of ceramic tiles, cracks cannot propagate from one tile to another if the material between the tiles has an effective impedance much lower than the ceramic. Stress waves can still damage tiles adjacent to an impacted tile by (1) stress wave propagation through the inter-tile material and into the adjacent tiles, (2) rapid lateral displacement of ceramic debris from the impacted tile, and (3) the deflection and vibration of the backing material.

The damage produced in ceramic hard face components by projectile impact can be classified into (1) a zone of highly pulverized material in the shape of a conoid under the incident projectile footprint, (2) radial and circumferential cracks, (3) spalling, through the thickness and lateral directions by reflected tensile pulses, and (4) impact from adjacent fragments. Crack propagation is arrested at the boundaries of an impacted tile if the web between the tiles in the tile array is properly designed. However, stress wave propagation can occur through the web and into the adjacent tiles and can still damage the adjacent tiles. The lateral displacement of ceramic debris during the fracturing of an impacted tile can also damage the adjacent tiles, reducing their capability to defeat a subsequent projectile impact. At late-time in the ballistic event, the slowing projectile induces bending waves in the backing material. These bending waves can cause (1) permanent plastic deformation of the backing plate which degrades the support of adjacent tiles, (2) bending fracture of adjacent ceramic tiles, or (3) eject the ceramic tiles from the backing plate.

A challenge to developing multi-hit ceramic armor is to control the damage created in the ceramic plates and the backing plate. The ability to defeat subsequent hits that are proximate to previous hits can be degraded by (1) damage to the ceramic or backing around a prior hit and/or (2) loss of backing support of tile through backing deformation. Early in the impact event, this damage can be created by stress wave propagation from the impact site. Later in the event, the entire armor panel becomes involved with a dynamic movement of the panel during the ballistic event. This later response of the panel to the threat's energy absorption can cause further damage to the armor system, often remote from the impact site. The development of multi-hit ceramic armors requires consideration of the panel size and the support condition of the panel.

The present invention includes a defined void in the ceramic element. This defined void may limit lateral damage, increase ballistic efficiency, and allow multiple impacts without ballistic performance degradation. The void in the ceramic element may (1) attenuate shock waves, (2) accommodate the lateral displacement of the ceramic fracturing ceramic, and (3) isolate adjacent tiles during the backing deformation stage. Many current armor systems utilize individual tiles laid up in an array, usually aligned end to end. The tiles are gapped to improve the multi hit properties of the systems and an armor strip is placed over the gap to improve the otherwise reduced ballistic performance at the gap.

The air gap is known to provide a very low impedance to the shock wave generated during the ballistic event. The addition of the strip, however, adds weight to the overall system and complicates produceability. This complication is particularly apparent with a ballistic article requiring a compound curve, such as the SAPI plate, because forming both the tile and the strips in a uniform including shaped parts is difficult. Shaped tiles are further complicated because they tend to shrink non-uniformly. This makes any resulting sintered tiles difficult to align, and typically results in gaps of non-uniform thickness. Non-uniform gaps are less desirable than uniform gaps because a uniform gap will produce a more consistent ballistic result.

A new approach of the present invention and different from conventional ballistic structure design includes forming at least one defined void in the ceramic element of the ballistic structure, such as a SAPI plate. This eliminates the need to use individual tiles laid up in an array, although the present invention may also be used with individual tiles laid up in an array. The present invention enables one ceramic element to be used where it has conventionally been necessary to use a plurality of individual ceramic tiles or elements.

A defined void is a void, gap, or open space, in the ceramic element that is intentionally placed and has predetermined measurement dimensions.

The configuration of the defined voids may be selected to accommodate the needs of a particular application without departing from the spirit and scope of the invention. For example, the defined voids of some embodiments are a series of holes having a cylindrical shape that extend through part or all of the ceramic element. The defined voids in other embodiments include holes of any other shape. Other embodiments use indentations as defined voids. Some embodiments employ slits as defined voids. The invention is described in exemplary terms of slits, but other embodiments utilize other defined voids.

Some embodiments include slits passing completely through the ceramic element, some embodiments include slits of varying depths not passing through the ceramic element, and some embodiments have combinations of through slits and partial depth slits. Some embodiments include slits that are cut from both the front and the rear of the ceramic element, but do not pass completely through the element. The slits can be arranged in a variety of different patterns.

The configuration of the slits, their width, depth, and placement can be varied widely to accommodate a particular threat and the ballistic requirements. The method of introducing the slit into the ceramic element can also vary widely. The ceramic element can be machined prior to sintering with conventional cutting tools and conventional or computer numeric control (CNC) equipment. A waterjet can be used with great precision and to good effect. A CNC waterjet can yield many slit widths, including an ultra thin slit, of any desired pattern and depth. The slits also can be made in a very uniform manner pre- or post-sintering with the use of a laser. The ceramic elements may be pre-sintered, or sintered after the defined voids are cut.

Figure 1:
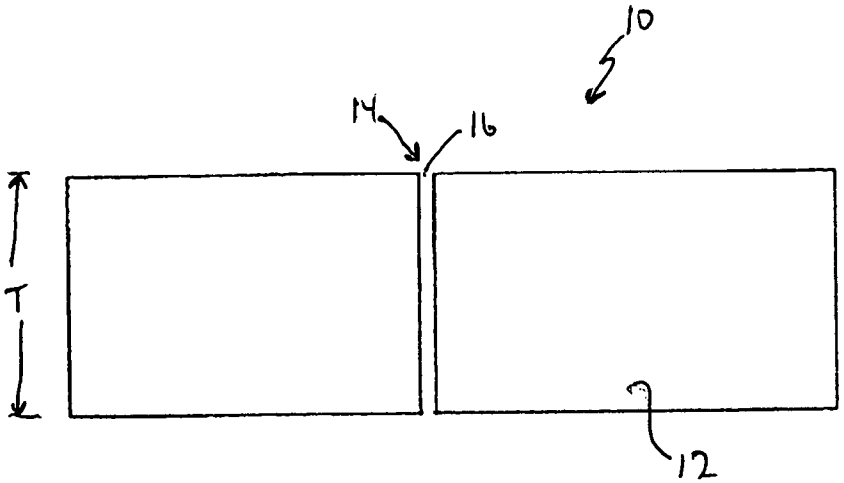
FIG. 1 is a cross-sectional view of an exemplary ceramic element with a slit that passes thru the thickness of the ceramic element.

FIG. 1 illustrates an exemplary cross-sectional view of one embodiment of a ballistic structure 10, including a ceramic element 12 with a defined void 14. In the embodiment of FIG. 1, the defined void 14 is illustrated as a slit or hole 16. The ceramic element 12 has a thickness T. The slit or hole 16 extends through the entire ceramic element 12. Thus, the depth of the slit is at least T.

Figure 2A:
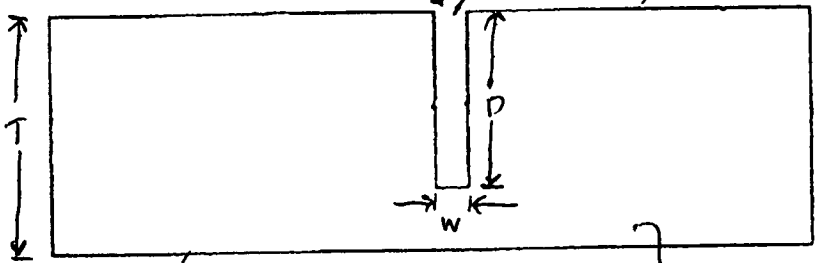

FIG. 2A illustrates a cross-sectional view of another embodiment of a ceramic element 12 having thickness T. In this embodiment, the slit or hole 16 has a depth D that is less than the thickness T of the ceramic element 12. The slit 16 has a width W. The slit 16 is open to the front or strike surface 18. The slit does not penetrate the rear, non-strike surface 19. Both the depth D and the width W can be expressed in terms of the thickness T.

FIG. 2B illustrates a cross-sectional view of another embodiment of a ceramic element 12 having a slit 16. In this embodiment, the slit 16 is open to the rear or non-strike surface 19 and does not penetrate the front, or strike, surface 18.

FIGS. 3A through 3E illustrate one embodiment of the ceramic element 12 with a pattern of slits 36. This embodiment exemplifies use in a SAPI plate. As illustrated by FIG. 3A, the slits form a substantially hexagonal pattern. The slits 36 arranged in this pattern separate the ceramic element 12 into several segments 37, or pieces, for example, nine segments. Separate ballistic segments are described in greater detail below.

FIG. 3B illustrates a cross-sectional view along line A-A of FIG. 3A. FIG. 3C is a detail view of the area indicated as B in FIG. 3B. The slit 36 passes through the front or strike surface 38 and through the rear, non-strike surface 39. The slit 36 penetrates the entire thickness T of the ceramic element 12. FIG. 3D illustrates the pattern of slits 36 as seen from the front, and FIG. 3E illustrates the pattern of slits shown from the rear.

FIGS. 4A through 4E illustrate another embodiment of the present invention having both partial slits 45 that do not extend all the way through the ceramic element 12 and through slits 46 that extend all the way through the ceramic element 12. The slits 45, 46 alternate in this pattern. This embodiment exemplifies use in a SAPI plate. As illustrated by FIG. 4A, the slits 45, 46 form a substantially rectangular pattern. The slits 45, 46 arranged in this pattern separate the ceramic element 12 into several segments 47, or pieces.

FIG. 4B illustrates a cross-sectional view along line A-A of FIG. 4A. FIG. 4C is a detail view of the area indicated as B in FIG. 4B. The through slit 46 passes through the front or strike surface 48 and through the rear, non-strike surface 49. The through slit 46 penetrates the entire thickness T of the ceramic element 12. FIG. 4D illustrates the pattern of through slits 46 as seen from the front, and FIG. 4E illustrates the pattern of slits 45, 46 shown from the rear.

FIGS. 5A through 5E illustrate another embodiment of the ceramic element 12 with a pattern of slits 56. This embodiment exemplifies use in a SAPI plate. As illustrated by FIG. 5A, the slits form a substantially hexagonal pattern. The slits 56 arranged in this pattern separate the ceramic element 12 into several segments 57, or pieces, for example, nine segments or 16 segments.

FIG. 5B illustrates a cross-sectional view along line A-A of FIG. 5A. FIG. 5C is a detail view of the area indicated as B in FIG. 5B. The slit 56 passes through the front or strike surface 58, but not through the rear, non-strike surface 59. The slit 56 penetrates only a percentage of the thickness T of the ceramic element 12. FIG. 5D illustrates the pattern of slits 56 as seen from the front, and FIG. 5E illustrates that the pattern of slits 56 is not visible from the rear 59, because the slits 56 do not penetrate the rear 59.

FIGS. 6A through 6E illustrate another embodiment of the ceramic element 12 with a pattern of slits 66. This embodiment exemplifies use in a SAPI plate. As illustrated by FIG. 6A, the slits form a substantially hexagonal pattern. The slits 66 arranged in this pattern separate the ceramic element 12 into several segments 67, or pieces, for example, nine segments or 16 segments.

FIG. 6B illustrates a cross-sectional view along line A-A of FIG. 6A. FIG. 6C is a detail view of the area indicated as B in FIG. 6B. The slit 66 passes through the rear or non-strike surface 69, but not through the front, strike surface 68. The slit 66 penetrates only a percentage of the thickness T of the ceramic element 12. FIG. 6D illustrates that the pattern of slits 66 is not visible from the front 68, because the slits 66 do not penetrate the front 68, and FIG. 6E illustrates the pattern of slits 66 as seen from the rear 69.

FIGS. 7A through 7E illustrate a finished armor plate 70 as exemplary of one ballistic structure having a ceramic element 72 with an array of slits 76 that only partially perforate ceramic element 72, a ceramic reinforcing element 74, an adhesive element 77, a composite backing element 78, and a spall cover 79.

In some embodiments, a thin slit is preferred over a thicker slit. The thickness of a slit is described in terms of a ratio of the slit width W to the ceramic element thickness T. See FIGS. 1 and 2. In one embodiment, a slit with a width W that is about equal to or less than about 1/10 of the tile thickness T is used, including, for example, a slit with a width that is about equal to or less than about 1/50 or 1/80 of the sintered tile thickness T. Slits with a width greater than about 1/10 of the sintered tile thickness T may also be used without departing from the spirit and scope of the invention.

Patterns can be adjusted to control the ultimate shape resulting from shrinkage of the sintered ceramic element, as well as to control the effective number of ballistic segments that act independently in a ballistic event. A ballistic segment is an area of the ceramic element that acts substantially independently for crack propagation in a ballistic event. FIG. 4 shows an exemplary pattern, but any of a number of patterns could be used. Patterns that break the ceramic element into at least 2 segments per square foot are useful. Other embodiments use patterns that break the ceramic element into a greater number of segments, such as at least about 4 segments per square foot or at least 9 or more segments per square foot. Other embodiments with different A slit that fully penetrates the ceramic element is effective. The depth D of the slit can be adjusted, such as by adjusting the feed rate and pressure of the waterjet nozzle. A slit penetrating at least 10% of the tile thickness T is used in one embodiment. Other embodiments include a slit penetrating about at least 50% or a slit penetrating about at least 80% of the tile thickness T. The slit can be introduced into the ceramic element before firing of the ceramic element or after firing through grinding or with the use of a laser.

In one embodiment, the ballistic structure has at least one non-through slit in which the ratio of the slit width W to the thickness of the ceramic element T is less than or equal to about 1/10 and the slit depth D is greater than about 10% of the ceramic element thickness T and a at least one through slot in which the ratio of the slit width W to the thickness of the ceramic element T is less than or equal to about 1/10.

The ceramic element may be any suitable ceramic material, for example, aluminum oxide, silicon carbide, boron carbide, aluminum nitride, or titanium diboride. The thickness of the ceramic element is, for example, between 0.060" and 2", such as between 0.15" and 0.50".

In one embodiment, a ballistic structure or an armor material according to the present invention includes a ceramic component and a backing element. The backing element may be a metal or composite, or any other suitable material. In one embodiment, the backing element includes an adhesive layer and a composite backing.

In one embodiment, the ballistic structure includes a backing, with or without an adhesive, with fiber bundles of nylon, polypropylene, polyethylene, aramid, or liquid crystalline polymer fibers.

In one embodiment, the ballistic structure includes a composite backing with one or more reinforcement layers having fiber bundles with nylon, polypropylene, polyethylene, aramid, or liquid crystalline polymer fibers.

Any suitable adhesive may be selected for use with the present invention, for example, urethane, polysulfide, acrylic, or epoxy.

The ballistic structure and armor of the present invention provides multiple hit protection from armor piercing bullets and yet is light enough in weight to be worn by an individual without undue hindrance. It also is easily fabricated into both flat and shaped components without any weight addition. The ballistic structures of the present invention may be used as armor material, such as SAPI for personal body armor, for hand-held protective shields, and the like; for hard armor panels, for example with vehicles, buildings, and other structures; or in any other appropriate ballistic application.

EXAMPLES

Example 1

Slits were cut into a pre-sintered tile of 0.32" thickness using a 0.003" waterjet orifice, and the widths of these slits measured between 0.0025" and 0.010" in the post sintered state. After firing, the tile thickness measured at 0.32" and the widths of the slits measured between 0.008" and 0.0025". The ratio of tile thickness to slit width was between 40 and 128. Conversely, the ratio of slit width to tile thickness was between 1/40 and 1/128.

After sintering, the gaps of the slots that fully penetrated the plates had shrunk with different thicknesses in different areas of the plate, but were still within allowable tolerances. Further testing revealed that the plates with a through slot performed well on the second shot, and subsequent examination of the crack patterns of the tiles showed that the through slot substantially reduced the cracking and the propagation of cracking. This reduction in cracking allowed the second shots to hit on relatively intact tile, thereby improving its second shot performance. This is an effective method of imparting multi-hit performance into a ballistic structure.

Example 2

Additional testing was conducted on SAPI shaped plates in which slits were cut in the front of the tile that did not fully penetrate the pre-sintered tile. Slits were cut into the front face of a pre-sintered tile of 0.39" thickness using a 0.003" waterjet orifice, and the widths of these slits measured between 0.0025" and 0.008" in the post sintered state. The slits and the plate shrink more uniformly during sintering than with through slits. After firing, the tile thickness measured a nominal 0.325" and the widths of the slits measured between 0.008" and 0.0025". The ratio of tile thickness to slit width was between 40 and 128. Conversely, the ratio of slit width to tile thickness was between 1/40 and 1/128.

After sintering, the gaps of the slits that did not fully penetrate the plates had shrunk with different thicknesses in different areas of the plate, but were still within allowable tolerances. Further testing revealed that the plates with a partial slit on the strike side of the target performed well on the second shot, and subsequent examination of the crack patterns of the tiles showed that the slit substantially reduced the cracking and the propagation of cracking. This reduction in cracking allowed the second shots to hit on relatively intact tile, thereby improving its second shot performance. This is an effective method of imparting multi-hit performance into a curved plate.

Example 3

More testing was conducted on SAPI shaped plates in which the slits that were cut in the front of the tile were of varying depth, with slits alternating between 100% through the plate with about ½ inch length and 80% through the plate with an equal length. Slits were cut into the front face of a pre-sintered tile of 0.39" thickness using a 0.003" waterjet orifice, and the widths of these slits measured between 0.001" and 0.0045" in the post-sintered state. After firing, the tile thickness measured 0.32". The ratio of tile thickness to slit width was between 40 and 128. Conversely, the ratio of slit width to tile thickness was between 1/40 and 1/128.

After sintering, the slit widths of the plates with the non-through slits had shrunk more uniformly than the slit widths of the plates cut with a through slit. Further testing revealed that the zone of damage on a single shot of the plate with non-through slits surprisingly did not pass through the slit. This reduction in cracking and the propagation of cracking would allow the second shots to hit on relatively intact tile, thereby improving its second shot performance. This is an effective method of imparting multi-hit performance into a curved plate and the slits and the plate shrink more uniformly during sintering.

Upon impact of a 0.30 cal AP projectile, the tile segmented by the slits tended to preferentially break away further aiding in segmenting the tile segment from its surrounding tile. This method of imparting multi-hit performance into a curved plate results in the slits and the plate shrinking the least and most uniform size sintering, and the dynamic failure of the plate also enhances multi-hit performance. The plate also surprisingly exhibited excellent durability, both pre- and post-sintering.

Example 4

Further testing was conducted on SAPI shaped plates where the slits that were cut in the rear of the tile and did not fully penetrate the pre-sintered tile. Slits were cut into the rear face of a pre-sintered tile of 0.39" thickness using a 0.003" waterjet orifice, and the widths of these slits measured between 0.001" and 0.0025" in the post-sintered state. After firing, the tile thickness measured at 0.32" and the widths of the slits measured between 0.001" and 0.0025". The ratio of tile thickness to slit width was between 40 and 128. Conversely, the ratio of slit width to tile thickness was between 1/40 and 1/128.

After sintering, the widths of the slots that did not fully penetrate the plates had shrunk with varying uniform thicknesses in different areas of the plate, and with a very tight tolerance. Further testing revealed that the plates with a partial slit on the rear of the plate performed well on the second shot, and subsequent examination of the crack patterns of the tiles showed that the partial slit substantially reduced the cracking and the propagation of cracking.

This reduction in cracking allowed the second shots to hit on relatively intact tile, thereby improving its second shot performance. In this method of imparting multi-hit performance into a curved plate, the slits and the plate shrank most uniformly during sintering.

Upon impact of the 0.30 cal AP projectile, the tile sectioned by the slits tended to preferentially break away, further aiding in segmenting the tile segment from its surrounding tile. This method of imparting multi-hit performance into a curved plate results in the slits and the plate shrinking the least and results in the most uniform size sintering. The dynamic failure of the plate also enhances multi-hit performance. The plate also surprisingly exhibited excellent durability, both pre- and post-sintering.

While the present invention has been illustrated by the above description of embodiments, and while the embodiments have been described in some detail, it is not the intention of the applicant to restrict or in any way limit the scope of the invention to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit or scope of the applicant's general or inventive concept.

I claim:

1. A ballistic structure for providing protection against a projectile comprising:

a single monolithic ceramic plate having a convex strike-face and a concave nonstrike-face; and a first group of slits having a slit width less than or equal to about 1/10 the thickness of the single monolithic ceramic plate, a slit depth penetrating all the way through the single monolithic ceramic plate, and a slit length;

wherein the first group of slits are arranged in a first pattern forming a two-dimensional grid of polygons etched in the convex strike-face of the single monolithic ceramic plate;

wherein each ballistic segment is represented on the convex strike-face of the single monolithic ceramic plate by a polygon from the first pattern;

wherein each polygon from the first pattern is bound by a series of straight lines and vertices such that the endpoints associated with each straight line do not intersect with the endpoints associated with adjacent straight lines, thereby keeping the boundary around each polygon from the first pattern open at each vertex;

wherein adjacent polygons from the first pattern share one or more vertices;

wherein each straight line of each polygon from the first pattern comprises one or more slits from the first group of slits; and wherein the first pattern divides the single monolithic ceramic plate into multiple ballistic segments for limiting projectile-induced cracks from propagating from one ballistic segment to a neighboring ballistic segment, thereby providing protection against a second projectile.

2. The ballistic structure of claim 1, wherein the polygons from the first pattern are hexagons.

3. The ballistic structure of any one of claims 1-2, wherein the first group of slits have a slit width of from about 1/128 to about 1/40 the thickness of the single monolithic ceramic plate.

4. A small arms protective insert for use with personal body armor to provide a protective barrier against projectile penetration, the insert comprising the ballistic structure of claim 1.

* * * * *

UNITED STATES PATENT AND TRADEMARK OFFICE

CERTIFICATE OF CORRECTION

PATENT NO. : 7,617,757 B2
APPLICATION NO. : 11/440669
DATED : November 17, 2009
INVENTOR(S) : Lawrence J. Dickson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 364 days.

Signed and Sealed this

Nineteenth Day of October, 2010

David J. Kappos

David J. Kappos
*Director of the United States Patent and Trademark Office*